US005355858A

United States Patent [19]

Kiyomura et al.

[11] Patent Number: 5,355,858

[45] Date of Patent: Oct. 18, 1994

[54] ASSIST-AIR TYPE FUEL INJECTION METHOD AND DEVICE FOR INTERNAL COMBUSTION ENGINE

[75] Inventors: Akira Kiyomura; Kazumitsu Kobayashi, both of Isesaki, Japan

[73] Assignee: Japan Electronic Control Systems Co., Ltd., Isesaki, Japan

[21] Appl. No.: 5,737

[22] Filed: Jan. 19, 1993

[30] Foreign Application Priority Data

Apr. 7, 1992 [JP] Japan ..... 4-114143

[51] Int. Cl.[5] ..... F02M 23/12; F02M 51/02

[52] U.S. Cl. ..... 123/457; 123/585

[58] Field of Search ..... 123/463, 585, 531, 533, 123/457

[56] References Cited

U.S. PATENT DOCUMENTS 5,156,133 10/1992 Sugimoto et al. ..... 123/585 X

FOREIGN PATENT DOCUMENTS 202357 11/1983 Japan ..... 123/463

63-275863 11/1988 Japan .

1-85462 6/1989 Japan .

*Primary Examiner*—Tony M. Argenbright

*Attorney, Agent, or Firm*—Foley & Lardner

[57] ABSTRACT

In an assist-air type fuel injection device for an internal combustion engine in which an assist-air for atomizing fuel is supplied toward an injected fuel on the lower stream of a nozzle hole of a fuel injection valve, a pressure detection part for detecting a pressure of the above assist-air is provided at the fuel injection valve, and the pressure of the assist-air detected at the above pressure detection part is supplied as a signal pressure to a pressure regulator for regulating a fuel supply pressure to the fuel injection valve. Without being affected by the assist-air pressure, a fuel flow rate can be stabilized, whereby control accuracy of the fuel injection amount can be maintained favorably.

9 Claims, 4 Drawing Sheets 1
2
3
4
5
5A
5B
6
7
8
9
11
12
13
14
16
18
19
20
21
22
23
31
32
44
48
49

ASSIST-AIR TYPE FUEL INJECTION METHOD AND DEVICE FOR INTERNAL COMBUSTION ENGINE

BACKGROUND OF THE INVENTION (1) Field of the Invention

The present invention relates to an assist-air type fuel injection method and device in a fuel-injection type internal combustion engine for an automobile and so on in which an assist-air is supplied toward an injected fuel so as to promote atomization of fuel injected from a fuel injection valve.

(2) Related Art

In a fuel injection type internal combustion engine, there have been generalized, in order to improve idling stability and transition response through improvement in combustibility, those provided with an assist-air type fuel injection device in which an assist-air is supplied toward a fuel injected from a fuel injection valve to an intake system so as to promote atomization of the fuel for improved atomization and mixing performance of the fuel and sucked air (See Japanese Unexamined U.M. Publication No. 1-85462).

In this kind of fuel injection type internal combustion engine, a fuel injection amount is controlled by controlling an injection period (injection pulse width) and regulating fuel injection pressure from the fuel injection valve with a pressure regulator.

Therefore, an intake pressure is introduced as a signal pressure from a collector part of the intake system and so on to a signal pressure chamber of the pressure regulator to keep the fuel pressure supplied to the fuel injection valve at a pressure higher than the above intake pressure by a constant differential pressure, by which the fuel is injected and supplied (See Japanese Unexamined Patent Publication No. 63-275863).

However, with such a conventional pressure regulating method, with regard to those in which the assist-air is supplied to the injected fuel as mentioned above, the pressure at a nozzle part of the fuel injection valve is higher than the intake pressure of the intake system, and an injection flow rate is restrained by an influence of the supply pressure of the above assist-air, whereby the fuel injection amount is diminished from a control amount.

That is, when the pulse width of an injection signal applied to the fuel injection valve is sequentially increased in the state where supply of the assist-air is stopped, the injection flow rate of the fuel is increased in proportion to the pulse width as shown by a characteristic line 24 shown by the two-dot and dashes line in FIG. 4. However, when the assist-air is supplied, the injection flow rate is lowered because it is affected by this air pressure as shown by a characteristic line 25 shown by the solid line.

SUMMARY OF THE INVENTION

The present invention was made in view of the aforementioned problems, and the object of the present invention is to prevent the injection flow rate of the fuel injected from the fuel injection valve from being affected by the supply pressure of the assist-air, whereby control accuracy of the fuel injection amount is kept favorably.

Another object is to detect the supply pressure of the assist-air with high accuracy for the above purposes.

In order to solve the above mentioned problems, in an assist-air supply method and device for a fuel injection valve of the type that the fuel is directly injected into the combustion chamber according to the present invention, the pressure of the assist-air supplied to the fuel injection valve is detected at an assist-air supply part on the lower stream side of the nozzle hole of the fuel injection valve (pressure detection part), and the pressure of the assist-air thus detected is supplied as the signal pressure of the above pressure regulator (signal pressure supplying means).

With the above constitution, the injection pressure of the fuel regulated at the pressure regulator can be kept at a constant differential pressure all the time against the assist-air supply pressure. As a result, without being affected by the supply pressure of the assist-air, the injection flow rate from the fuel injection valve (per unit time) can be stabilized, whereby fuel injection amount control with high accuracy can be maintained.

Also, it is advantageous that in those provided with a cylindrical space in continuation to the nozzle hole part to which the fuel injected from the nozzle hole is introduced and an air introduction path for introducing the assist-air toward the above cylindrical space, the assist-air pressure in the above cylindrical space is detected.

In this way, as the cylindrical space is filled with the assist-air, the supply pressure of the assist-air can be detected with high accuracy.

In particular, by detecting the pressure in the neighborhood of the nozzle hole in the cylindrical space, the fuel injection pressure is further stabilized so as to promote stabilization of the injection flow rate.

The present invention will be hereinafter described based on a preferred embodiment referring to attached drawings, but the present invention is not limited to the embodiment but includes variations within the scope of the objectives and technical aspects of the present invention.

EMBODIMENT

Figure 1:
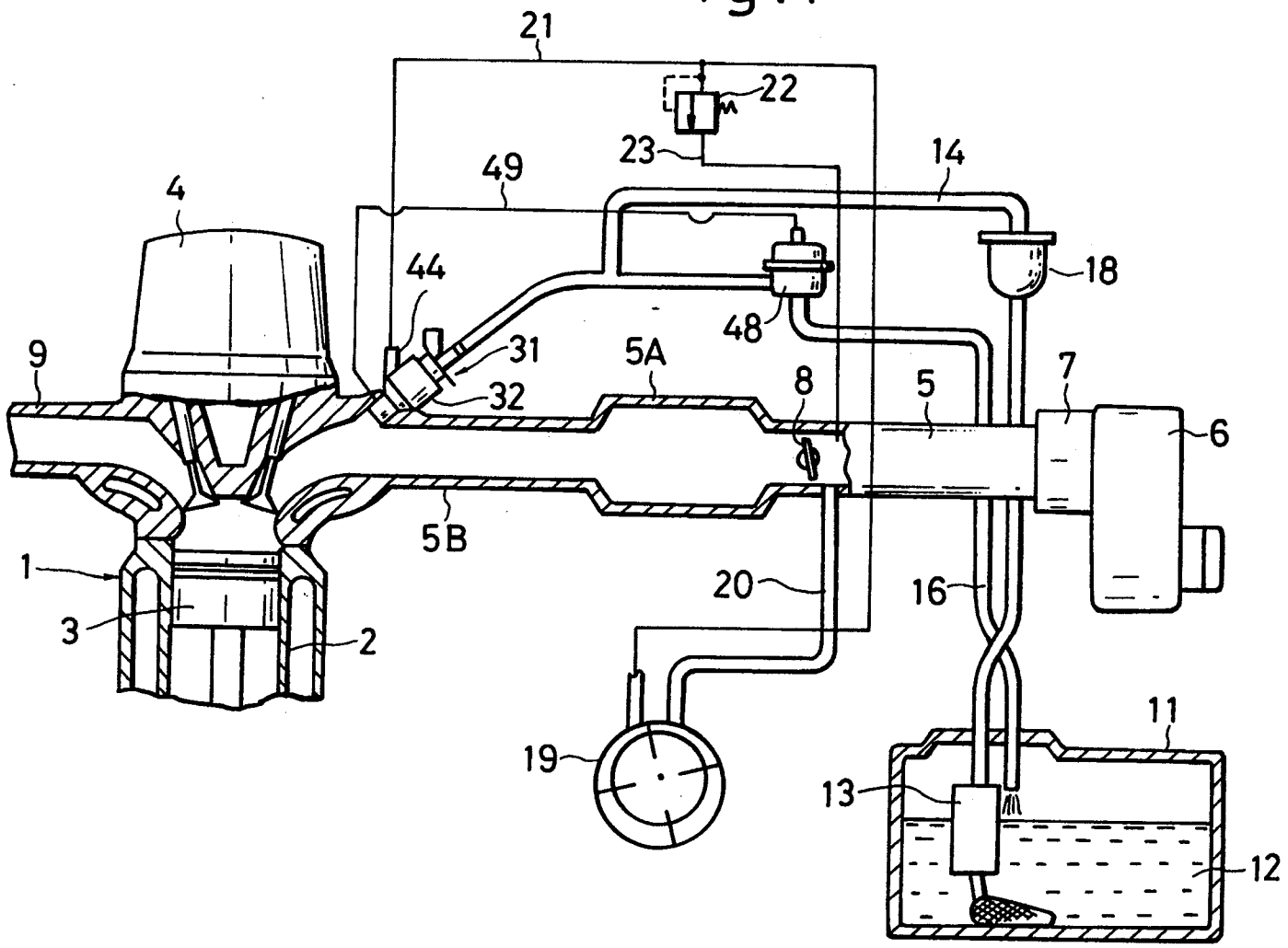
FIG. 1 is an overall diagram showing an assist-air fuel injection device according to a preferred embodiment of the present invention.

In the FIGS., an engine body 1 of an internal combustion engine for an automobile is schematically constituted by, for example, four cylinders 2 (only one of them is shown), a piston 3 which reciprocates in the above cylinder 2 for taking out revolution output from a crank shaft (not shown) and a cylinder head 4 mounted on the cylinder 2. An intake pipe 5 is connected to the intake side of the above cylinder head 4, an air cleaner 6 is provided at the tip end of the above intake pipe 5, and at the lower stream side of the above air cleaner 6, there are provided an air flow-meter 7 for detecting an intake air flow rate Q and a throttle valve 8 for regulating the intake air flow rate Q.

Here, the above intake pipe 5 is provided with a collector 5A as an intake reservoir on the lower stream side of the throttle valve 8, and with branch pipes 5B (only one of them is shown) communicating into each of the cylinders 2, respectively, on the lower stream side of the above collector 5A. That is, each of the above branch pipes 5B forms an intake manifold together with the collector 5A, and each of the above branch pipes 5B is branched from the collector 5A into, for example, four pipes and connected to each of intake ports of the cylinder head 4. Also, an exhaust pipe 9 comprising an exhaust manifold and so on is connected to each of the exhaust ports of the cylinder head 4 so that combustion gas in the cylinder 2 is exhausted as an exhaust gas through the above exhaust pipe 9 to outside.

On the lower stream end of each of the above branch pipes 5B, assist-air type fuel injection valves 31 (only one of them is shown) according to the present invention are provided, and an electromagnetic actuator is incorporated in each of the above fuel injection valves 31 for injecting fuel into each of the cylinders 2.

A supply system of fuel to the above fuel injection valve 31 will be described. A fuel pump 13 is provided at a fuel tank 11, the above fuel pump 13 press-feeds and supplies fuel 12 in the fuel tank 11 to a fuel piping 14, and a part of this fuel is returned to the fuel tank 11 from a pressure regulator 48 through a return piping 16. Here the above pressure regulator 48 introduces a supply pressure of the assist-air detected as will be described later through an air conduit 49 as a signal pressure and controls fuel pressure in the fuel piping 14 based on this signal pressure so that fuel is injected from each of the fuel injection valves 31 at this fuel pressure. Also, a fuel filter 18 is provided on the upper stream side of the above pressure regulator 48 of the fuel piping 14.

Then, the supply system of the assist-air will be described. An air pump 19 pressurizes an air sucked from a part between the air flow-meter 7 and the throttle valve 8 of the above intake pipe 5 through a conduit 20 and discharges it as the assist-air from a conduit 21 on the discharge side. To the middle of the above conduit 21, a relief valve 22 is connected through a conduit 23, and the above conduit 23 is connected to the intake pipe 5 as with the above conduit 20. And this relief valve 22 controls the assist-air in the conduit 21 at a set pressure Pa and relieves an excess pressure into the intake pipe 5 though the conduit 23. Here, the relief valve 22 constitutes an assist-air supply means together with the air pump 19 and the conduits 21, and so on so as to supply the assist-air at the set pressure Pa to each of the fuel injection valves 31.

Then, the internal structure of the fuel injection valve will be described based on FIG. 2 and FIG. 3.

The fuel injection valve 31 incorporates the electromagnetic actuator (not shown) and is schematically constituted by an injection valve body 32 is which the fuel piping 14 is connected to its base end side, an injection nozzle 33 provided on the tip end side of the above injection valve body 32 for injecting the fuel supplied into the injection valve body 32 through the fuel piping 14 to outside from a nozzle hole 33A, and is a needle valve 34 slidably fitted in the injection nozzle 33 so that it sits on and leaves a valve seat 33B of the above injection nozzle 33 and driven by the electromagnetic actuator in the injection valve body 32 for opening and closing the nozzle hole 33A.

The periphery of the above injection nozzle 33 is covered by a cover 35 in the stepped cylindrical shape. The above cover 35 is secured to the injection valve body 32 at the base end side, and on the tip end side, a lid body 37 in the stepped cylindrical shape is mounted through a cylindrical short spacer 36 between it and the tip end of the injection nozzle 33. And the above cover 35 forms an air chamber 38 around the injection nozzle 33 together with the lid body 37 and so on, and the assist-air is supplied into the above air chamber 38 from the side of an air inlet 44B, which will be described later. Also, the tip end of the lid body 37 is projected downward from the cover 35 and secured to the tip end of the cover 35 with the cylindrical spacer 36 by screwing a nut 42, which will be described later, to the projected end.

A cylindrical sleeve 39 is provided between the cylindrical spacer 36 and the lid body 37. The above sleeve 39 forms a swirl chamber 40 in the middle of a channel of the fuel injected from the above injection nozzle 33 toward an atomizing hole 43A, which will be described later, so as to give a swirl to the injected fuel in this swirl chamber 40. Here, an annular path 41 is formed between the above sleeve 39 and the lid body 37, and the above annular path 41 communicates to the air chamber 38 all the time through four air paths 37A, 37A, . . . formed extending in the tangent direction to the lid body 37 as shown in FIG. 3. Also, at the sleeve 39, air nozzles 39A, 39A, . . . in four sets, for example, are formed, in which four nozzles constitute one set as shown in FIG. 3, extending in the tangent direction from the swirl chamber 40 and vertically separated as shown in FIG. 2.

And the assist-air in the air chamber 38 flows in the tangent direction (direction shown by the arrow A in FIG. 3) to the annular path 41 though each of the air paths 37A of the lid body 37, and supercharged assist-air in the annular path 41 is brought into the swirl state and flows in the arrow B direction to the swirl chamber 40 through each of the air nozzles 39A of the sleeve 39 so as to give the swirl in the arrow B direction to the fuel injected from the nozzle hole 33A to promote atomization of the injected fuel.

As mentioned above, the nut 42 is screwed on a screw part 37B of the lid body 37 and brought into contact with the end surface of the tip end of the cover 35, the above nut 42 screws a stepped cylindrical atomizing cylinder 43 to the inner periphery of the tip end of the lid body 37, and the inner periphery of the above atomizing cylinder forms the atomizing hole 43A in the tapered state that is gradually expanded downward. The above atomizing cylinder 43 injects the fuel injected from the nozzle hole 33A of the injection nozzle 33 and atomized by having swirled in the swirl chamber 40 toward the cylinder 2 of the engine body 1 from the atomizing hole 43A with the assist-air.

Also, in order to introduce the assist-air into the air chamber 38 of the fuel injection valve 31, an air introduction part 44 is provided in continuation to the cover 35, and in the above air introduction part 44, a valve storing hole 44A forming a part of the air channel is formed, and the tip end of the above valve storing hole 44A is a small-diameter air inlet 44B communicating to the air chamber 38. And the above air inlet 44B is connected to the conduit 21 through a path 44C extending in the radial direction from the middle of the valve storing hole 44A, and the assist-air is supplied from the above conduit 21 toward the air chamber 38.

Figure 2:
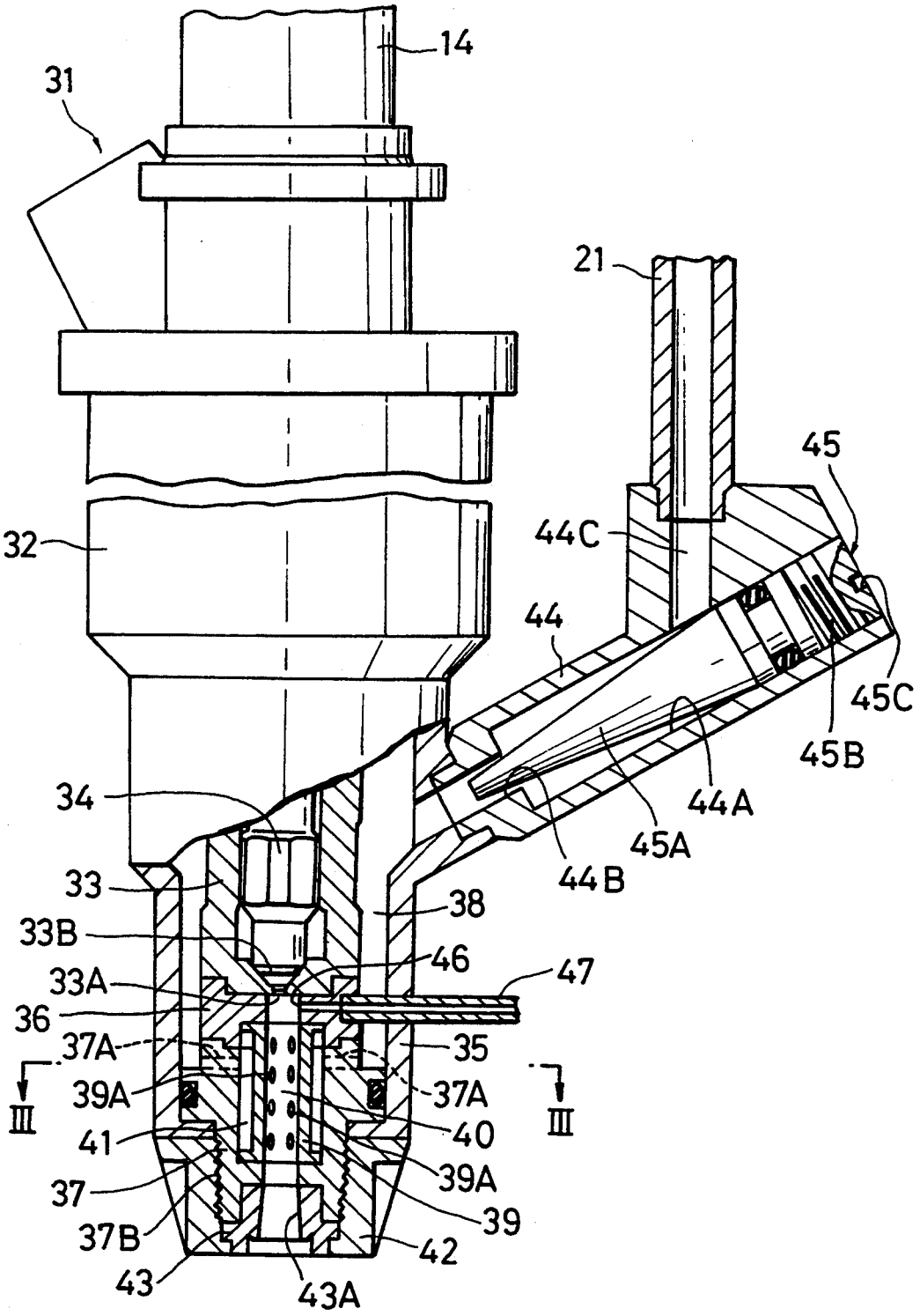
FIG. 2 is an enlarged sectional view showing an essential part of an injection valve shown in FIG. 1.
Figure 3:
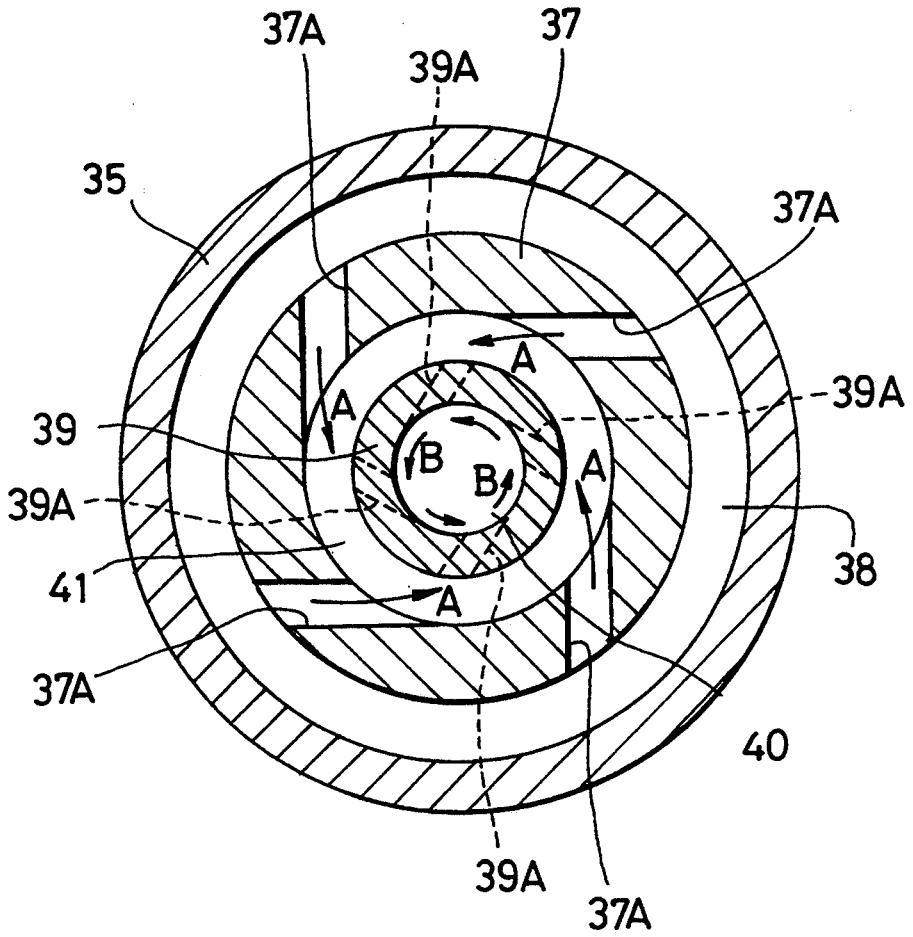
FIG. 3 is an enlarged sectional view taken along the line III—III in FIG. 2.

A variable throttle valve 45 is provided in the valve storing hole 44A of the above air introduction part 44, and the above variable throttle valve 45 is constituted by, as shown in FIG. 2, a tapered state valve part 45A and a screw part 45B located on the base end side of the above valve part 45A and in which a screw is formed on the outer periphery, and an engagement groove 45C to be engaged with a tool such as a driver (not shown) is formed on the end surface of the above screw part 45B. And the above throttle valve 45 is inserted from the base end side into the valve storing hole 44A and blocks the base end side of the valve storing hole 44A with the screw part 45B side. Also, by adjusting the screwing position of the screw part 45B in relation to the valve storing hole 44A, the tapered valve part 45A is moved backward in the axial direction so that the channel area of the above air inlet 44B is variably adjusted at the tip end of the valve part 45A.

The assist-air type fuel injection valve 31 with the above constitution is provided with a pressure detection part for detecting supply pressure of the assist-air as will be described in the following.

That is, located in the neighborhood of the nozzle hole 33A of the injection nozzle 33, a detection hole 46 as the pressure detection part is formed on the cylindrical spacer 36. The above detection hole 46 is located on the upper stream side of the swirl chamber 40 in the sleeve 39 and provided in the radial direction of the cylindrical spacer 36. Also, the above detection hole 46 is formed with a diameter smaller than that of each of the air nozzles 39A of the sleeve 39 so that it restricts flowing of the fuel injected from the nozzle hole 33A into the detection hole 46. And as the above detection hole 46 communicates into the cylindrical spacer 36 between the nozzle hole 33A of the injection nozzle 33 and the swirl chamber 40, the pressure of the assist-air supplied from each of the air nozzles 39A into the swirl chamber 40 is detected as pressure changing according to the pressure in the collector 5A (branch pipe 5B).

The base end of a small diameter detection pipe 47 is connected to the detection hole 46 of the above cylindrical spacer 36, and the above detection pipe 47 passes through the air chamber 38 in the radial direction and is fixed to the cylindrical spacer 36 and the cover 35, while its tip end is projected in the radial direction from the outer periphery of the cover 35. And one end of an air conduit 49 is connected to the projected end of the above detection pipe 47, while the other end of the above air conduit 49 is connected to a signal pressure inlet of the pressure regulator 48, as described above, so that the supply pressure of the assist-air detected at the detection hole 46 is introduced as a signal pressure to a signal pressure chamber of the pressure regulator 48.

For the above pressure regulator 48, those in the conventional structure are used, except that, as the assist-air supply pressure taken out of the detection hole 46 is introduced as the signal pressure, the fuel pressure in the fuel piping 14 is set higher by the supply pressure of the above assist-air in contrast with the intake pressure of the collector part that was conventionally introduced to the signal pressure chamber.

Here, a cylindrical space on the lower stream of the nozzle hole in the present invention is constituted by a space formed in continuation inside the cylindrical spacer 36, cylindrical sleeve 39, lid body 37 and the atomizing cylinder 43, an air introduction path is constituted by the air inlet 44, air chamber 38 and the plurality of air paths 37A, 37A, . . . . Also a signal pressure supply means is constituted by the detection pipe 47 and the air conduit 21.

Then, actions and effects of this preferred embodiment will be described.

The assist-air pressurized by the air pump 19 is introduced from the air inlet 44 into the fuel injection valve 31 through the air conduit 21 in which the relief valve 22 is provided and its flow rate is regulated by the throttle valve 45A and then, supplied into the air chamber 38. Moreover, as the assist-air in the air chamber 38 flows in the arrow A direction in FIG. 3 to the annular path 41 through each of the air paths 37A of the lid body 37 as well as in the arrow B direction to the swirl chamber 40 through each of the air nozzles 39A of the sleeve 39, the fuel injected from the nozzle hole 33A of the injection nozzle 33 toward the atomizing hole 43A is given a swirl by the assist-air in the swirl chamber 40 so that atomization of the fuel is effectively promoted to improve atomization and mixing performance with sucked air, whereby idling stability and transition response can be improved.

Figure 4:
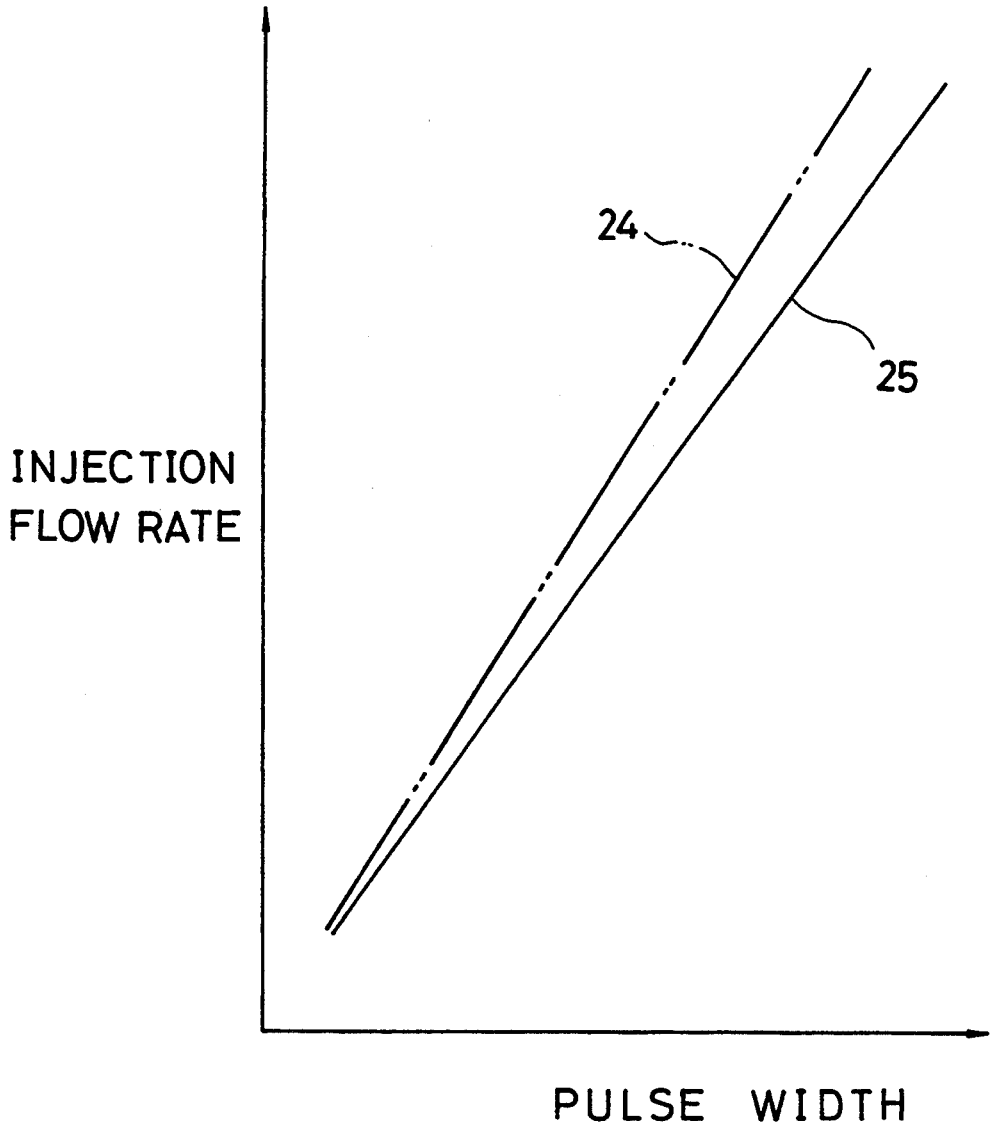
FIG. 4 is a characteristic line diagram showing the relation between pulse width and injection flow rate of an injection signal.

In the meantime, as the detection hole 46 formed at the cylindrical spacer 36 detects the pressure of the assist-air supplied into the swirl chamber 40 as changing pressure based on the pressure of the collector 5A or the branch pipe 5B and introduces this pressure as a signal pressure to the pressure regulator 48 through the detection pipe 47 and the air conduit 49, fuel pressure in the fuel piping 14 can be regulated higher by the pressure regulator 48 in response to the pressure of the assist-air so that the injection flow rate of the fuel injected from the nozzle hole 33A of the injection nozzle 33 can be kept at a characteristic line equivalent to the characteristic line 24 shown by the chain line in FIG. 4 of the case where the assist-air is not supplied, without being affected by the supply pressure of the assist-air, whereby control accuracy of the fuel injection amount can be maintained favorably.

Also, particularly in this preferred embodiment, as the pressure of the assist-air is taken out through the detection hole 46 from the part between the nozzle hole 33A and the swirl chamber 40, even if an air flow rate is dispersed because it is affected by an aperture of each of the air nozzles 39A formed on the sleeve 39 and so on, the fuel pressure is regulated based on the pressure detected on its upper stream side, the portion which is hard to be affected by dynamic pressure of the assist-air, therefore dispersion of the injected fuel flow rate can be restrained to a low level.

From the viewpoint of avoiding influence of the dynamic pressure of the assist-air, the pressure of the assist-air may be detected on the lower side of the sleeve 39, and in this case, the detection hole 46 may be provided in the radial direction of the lid body 37 and so on. However, in order to control the fuel injection amount with the highest accuracy only with control of the injection pulse width, it is desirable that the differential pressure against the pressure immediately after injection should be regulated constant, and control accuracy of the injection amount can be further improved with detection of the pressure at the portion closer to the nozzle hole 33A as shown in the preferred embodiment.

As mentioned above in detail, according to the present invention, as the fuel supply pressure to the fuel injection valve controlled by the pressure regulator is controlled based on the pressure of the assist-air supplied toward the injected fuel, the fuel supply pressure can be set higher according to the pressure of the assist-air and lowering of the injection flow rate of the fuel affected by supercharged assist-air can be prevented. Thus, even during supply of the assist-air, the flow rate characteristic of the injected fuel can be stabilized, whereby control accuracy of the injection amount can be improved.

We claim:

1. An assist-air type fuel injection method for an internal combustion engine in which a fuel pressure supplied to a fuel injection valve is regulated by a pressure regulator having a function to regulate the pressure so that a differential pressure from a signal pressure put in from the outside is made constant and an assist-air for promoting atomization of the fuel is supplied toward the injected fuel of said fuel injection valve, the method comprising the steps of:

detecting a pressure of the assist-air in an air chamber positioned between a nozzle hole of said fuel injection valve and at least one air nozzle; and supplying the detected pressure of the assist-air as the signal pressure for said pressure regulator.

2. An assist-air type fuel injection device for an internal combustion engine comprising a pressure regulator for regulating a pressure of a fuel discharged by a fuel pump so that a differential pressure from a signal pressure put in from the outside is made constant, a fuel injection valve for injecting the fuel whose pressure is regulated by said pressure regulator to an intake system of the engine and an assist-air supply means for supplying an assist-air for promoting atomization of the fuel toward the injected fuel of said fuel injection valve, the apparatus characterized in that a pressure detection means is provided for detecting a pressure of the assist-air in an air chamber positioned between a nozzle hole of said fuel injection valve and at least one air nozzle, and a signal pressure supply means is provided for supplying the pressure of the assist-air detected at said pressure detection means as the signal pressure of said pressure regulator.

3. An assist-air type fuel injection device for an internal combustion engine according to claim 2, wherein said pressure detection means detects the assist-air pressure at a part in the neighborhood of the nozzle hole in said air chamber.

4. An assist-air type fuel injection device for an internal combustion engine according to claim 2, wherein said fuel injection valve includes a cylindrical space in communication with the nozzle hole wherein fuel injected from the nozzle hole is introduced into the cylindrical space; and an air introduction path for introducing the assist-air toward said cylindrical space; wherein said pressure detection means detects the assist-air pressure in said cylindrical space.

5. An assist-air type fuel injection method for an internal combustion engine, comprising the steps of:

supplying fuel to a fuel injection valve;

regulating a pressure of the fuel so that a differential pressure from a signal pressure is constant;

supplying assist-air to the fuel injection valve for promoting atomization of the fuel;

detecting a pressure of the assist-air in an air chamber positioned between a nozzle hole of the fuel injection valve and at least one air nozzle; and supplying the detected pressure of the assist-air as the signal pressure of the pressure regulating step.

6. An assist-air type fuel injection device for an internal combustion engine comprising:

a pressure regulator for regulating a pressure of fuel discharged by a fuel pump so that a differential pressure from a signal pressure is constant;

a fuel injection valve for injecting the fuel whose pressure is regulated by said pressure regulator, to an intake system of the engine;

assist-air supply means for supplying an assist-air for promoting atomization of the fuel, toward the injected fuel of the fuel injection valve;

pressure detection means for detecting a pressure of the assist-air in an air chamber positioned between a nozzle hole of the fuel injection valve and an air nozzle; and signal pressure supply means for supplying the pressure of the assist-air detected at said pressure detection means as the signal pressure of said pressure regulator.

7. The assist-air type fuel injection device of claim 6, wherein the pressure detection means detects the assist-air pressure directly from a vicinity of the nozzle hole and the air chamber.

8. The assist-air type fuel injection device of claim 6, wherein said fuel injection valve further comprises a cylindrical space in communication with the nozzle hole wherein fuel from the nozzle hole is injected into the cylindrical space; and an air introduction path for introducing the assist-air toward the cylindrical space wherein said pressure detection means detects the assist-air pressure in the cylindrical space.

9. The assist-air type fuel injection device of claim 8, wherein the pressure detection means detects the assist-air pressure directly from a vicinity of the nozzle hole and the air chamber.

* * * * *